US005333727A

United States Patent [19]

Hoppe

[11] Patent Number: 5,333,727

[45] Date of Patent: Aug. 2, 1994

[54] ACCESSORY ORGANIZER

[76] Inventor: Donna T. Hoppe, 14765 Natchez Ave. S., Savage, Minn. 55378

[21] Appl. No.: 103,225

[22] Filed: Aug. 9, 1993

[51] Int. Cl.[5] ..... B65D 73/00

[52] U.S. Cl. ..... 206/6.1; 206/486; 206/495; 211/113

[58] Field of Search ..... 206/6.1, 486, 495, 566; 211/13, 70.1, 87, 88, 113, 118

[56] References Cited

U.S. PATENT DOCUMENTS

| | | | |
|---|---|---|---|
| 4,821,883 | 4/1989 | Miller | 206/495 |
| 4,905,821 | 3/1990 | Corbett | 206/566 |
| 4,958,727 | 9/1990 | Bergeron | 206/6.1 |
| 5,025,918 | 6/1991 | Bergeron | 206/495 |
| 5,050,745 | 9/1991 | Sanders | 206/495 |
| 5,121,833 | 6/1992 | Lindsay | 206/6.1 |
| 5,141,113 | 8/1992 | Elliott | 206/495 |
| 5,197,596 | 3/1993 | Garganese | 206/6.1 |
| 5,209,344 | 5/1993 | Smith | 206/6.1 |

*Primary Examiner*—Jimmy G. Foster
*Attorney, Agent, or Firm*—Joel D. Skinner

[57] ABSTRACT

An Accessory Organizer comprising a rectangular fabric base. The fabric base is sewn with trim. An additional piece of trim is extended on top in a semicircle to allow hanging of the base. Buttonholes are sewn onto the base in various numbers and positions to support items with clips. Two rods are glued to the base at its top and bottom to eliminate curling. This allows the base to be raised away from supporting surface. Appliques are attached to the rods to eliminate scratches to supporting surfaces.

1 Claim, 1 Drawing Sheet

ACCESSORY ORGANIZER

FIELD OF THE INVENTION

This invention relates to an apparatus for holding small objects or articles and in particular to an Accessory Organizer. The organizer is useful for helping an individual organize fashion accessories such as earings, barrettes, lapel or shirt pins, brooches, tie clips, cuff links, money clips, hair clips and combs, scarfs, scarf clips, bracelets, and necklaces.

BACKGROUND OF PRIOR ART

Accessories are considered an addition to existing necessities. More and more, accessories are being seen and used by everyone. Insofar as is known, there are not any similar items in use or proposed for organizing accessories. There are jewelry boxes, earring trees, segmented trays, tackle boxes, etc., which are used to organize acessories. However, these items all have various problems. The disadvantage of the jewelry boxes is that you can not see accessories easily. One has to open drawers and doors to find accessories. The disadvantage of earring trees is they are limited to earrings. The problem with a tackle box is that if it is dropped the items inside get all mixed up.

In addition to fashion accessories the Accessory Organizer can help organize any item which has a push pin, clip, hook, etc. Artists can orgainize paint brushes, drawing pens, etc. Fishermen can organize fish hooks, lures, etc. Teachers can organize gem clips, tacks, etc. The Accessory organizer can help a variety of individuals organize accessories in an orderly fashion for quick view and retrieval. Ordinary household items, which have heretofore been stored in a "junk drawer" may now be neatly stored without the risks of damage or becoming lost in "junk drawers".

SUMMARY OF THE INVENTION

In addition to easily finding and organizing accessories the following objects and advantages of this invention are:

a) To keep matched pairs of objects together, for example earrings, cuff links, etc. Pairs may be placed side by side on the Accessory Organizer.

b) To keep backs on pierced earings. Earrings are placed thru the base and the back is attached.

c) To eliminate scratching of precious items. Instead of placing items in a jewelry box or drawer where they get all entwined, they are hanged on the Accessory Organizer.

d) To easily view accessories at a glance.

e) To use when traveling. Needed accessories are attached, the Accessory Organizer is then rolled up and placed in a suitcase.

g) It hangs, it's aesthetically pleasing and is lightweight.

Further objects and advantages of this invention will be presented in the drawings and detailed description.

DETAILED DESCRIPTION OF THE PREFERRED EMBODIMENT

Figure 2:
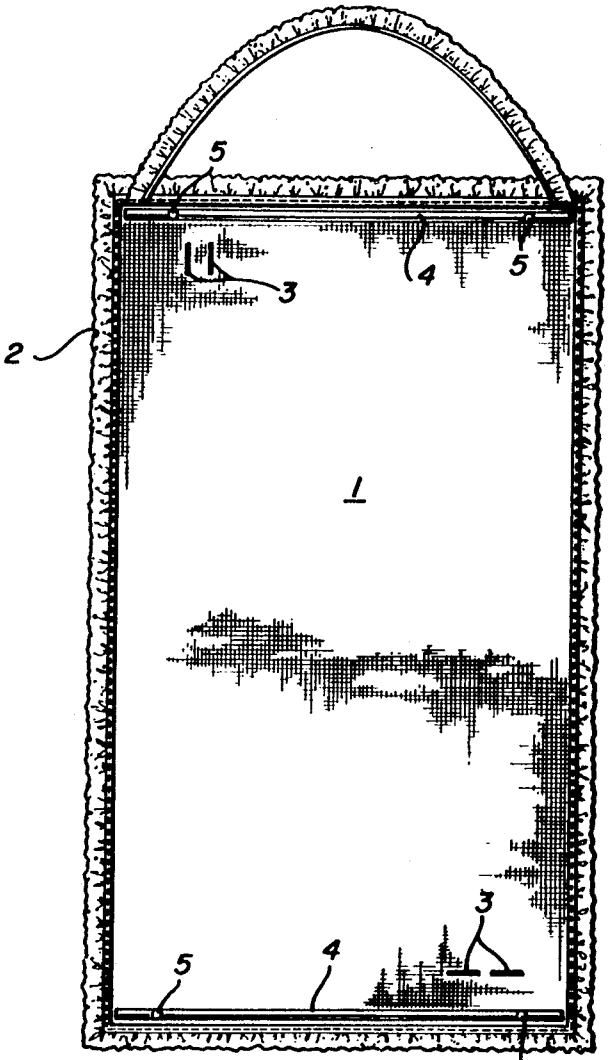
FIG. 2 shows a back view of the Accessory Organizer.
Figure 1:
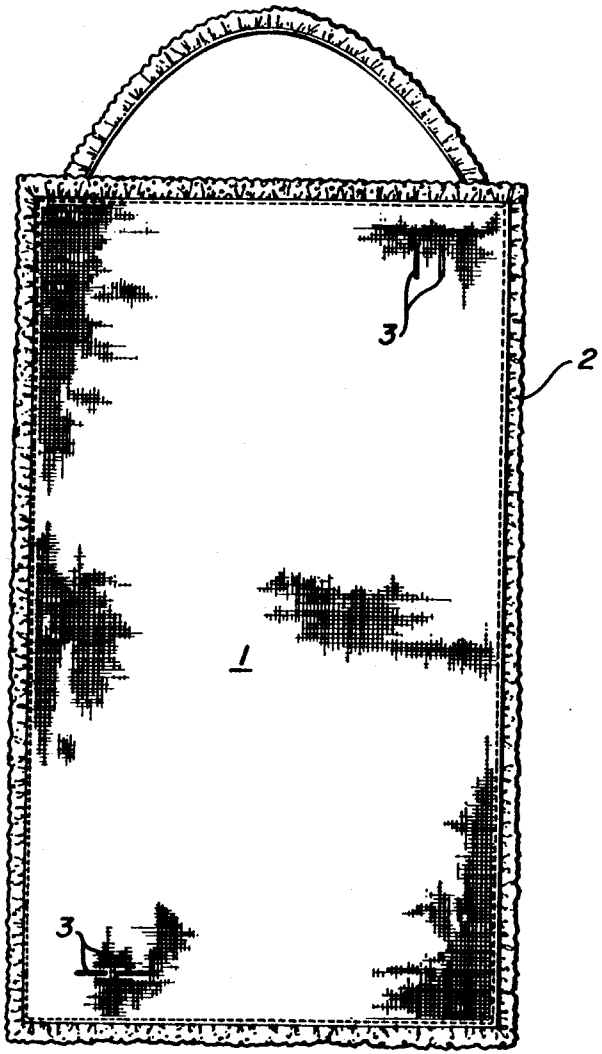
FIG. 1 shows a front view of the Accessory Organizer of this invention.

The preferred embodiment of the present invention is shown in FIG. 1 (front view) and FIG. 2 (back view).

The front view shows a rectangular shaped base 1, preferably formed of burlap, approximately 12 inches wide and 24 inches long, sewn with trim 2, approximately ½ inch wide. An additional piece of trim 2, approximately 12 inches long is extended on top in a semicircular fashion to allow the base 1 to be hung. Trim 2 is preferably formed of lace. Four buttonholes 3 are sewn onto the base 1; two horizontally and two vertically. The buttonholes 3 are sewn on the burlap base 1 to support accessories with clips and to eliminate raveling of the burlap. A small slit inside the buttonhole 3 would be necessary to insert the clips. The number and position of buttonholes 3 can vary.

The back view shows the rectangular shaped base 1, 12 inches wide and 24 inches long Two rods 4, approximately ½ centimeter wide and 11½ inches long are glued to the top and bottom of the base 1 to eliminate curling. The rods 4 are preferably constructed of wood. The rod 4 allows the base 1 to be raised from the wall or other supporting surface. Two pieces of felt 5 are preferably added to the wooden rods 4 to eliminate scratches to supporting surface.

The Accessory Organizer consists of four main elements: burlap base 1, lace trim 2, wooden rods 4, and felt appliques 5.

The preferred base 1 material is burlap. Other materials could be canvas, net, denim, upholstery, or a similar thin fabric. One advantage of burlap is its stiffness and grainy material. This allows for ease of attachment of accessories. The fabric is very flexible. Cream is the suggested color but any color will do. The size does not always have to be 12×24. The most practical is the 12" wide. The length could vary, ie; 12"- small, 18"-medium and 24"-large (as described above). The base 1 enables individuals to hang acessories on the burlap for quick retrieval and organization.

The base 1 can alternatively be square, round, octagon, etc. The verticle rectangular shape described here is the most versatile. It allows maximum room for accessories without looking cluttered.

The preferred trim 2 material is lace. Other suggested materials could include ribbon, fabric trim, etc. The chief advantage of lace is that it is sturdy enough to eliminate unraveling of the burlap base 1. It also gives support to hang the Accessory Organizer. It is also aesthetically pleasing. White is the preferred color used, but other colors could be used. A width of ½ inch provides a balance between function and appearance. The lace trim is used on the front of the burlap as a trim outline. It is also used on the top in a semicircle fashion to allow the burlap to be hung.

The rod 4 is used to eliminate curling of the burlap base 1. Other items could be used such as; weights, flat wood, etc. The wooden rods help keep the burlap base 1 away from supporting surfaces. The rods blend nicely with the cream burlap. The rods 4 don't take up much room, allowing most of the burlap base 1 to be used for its intended purpose, attaching accessories. The color and size could vary but the preferred is cream with a ½ centimeter width and length of 11½ inches The size and color listed above presents the best balance. Two round wooden rods are glued to the back, top and bottom, of the burlap to supply support to eliminate curling and raise the burlap away from the intended surface.

Felt appliques 5 are used for support to prevent the rods 4 from scratching the supporting surface. Two self stick felt appliques are placed on each wooden rod. Cotton, velvet, etc. are other materials that may be used. The color and size could vary. The preferred is green in color with ½ inch diameter.

Glue is used to hold the two round wooden rods 4 to the back of the burlap base 1. The rods 4 could be tied, stapled, or hand sewn to the burlap base 1. The glue holds the entire rod 4 in place and is virtually invisible.

Thread is used to sew the lace trim 2 around the perimeter of the burlap base 1. Thread is the preferred material but yarn, fishing line, staples, etc. could be used to attach the lace trim 2 to the burlap base 1. The thread is the most practical. Color can vary.

The advantages of this invention are:

(a) It is easy and simple to use.

(b) The burlap base 1 is sturdy enough to hold accessories.

(c) The lace trim 2 helps to eliminated raveling of the burlap base 1. The lace trim 2 also extends on the top to allow the burlap base 1 to be hung.

(d) The buttonholes 3 hold accessories with clips. They also help eliminate raveling.

(e) The rods 4 eliminate curling of the burlap base 1.

(f) The felt appliques 5 help eliminate scratches to supporting surface.

SUGGESTED MODES OF USE OF THE ACCESSORY ORGANIZER

1) Pierced earrings:

Place the earring post thru the burlap base 1 and attach the back. Place pairs side by side.

2) Clip on earrings:

Place the open clip thru a buttonhole 3 then close clip. Place pairs side by side.

3) Barretts:

Unclip the barrette. Place the barrette thru two buttonholes 3, then reclip.

4) Brooch:

Unfasten the brooch and place the post thru the burlap base 1 and back again, then refasten just as if you were attaching to a lapel.

SUMMARY

In summary, the Accessory Organizer is designed, to help an individual organize accessories. It is to be hung on the wall, cabinet door, etc. so you can quickly retrieve and replace accessories.

In addition to easily finding and organizing accessories the following objects and advantages of my invention are:

a) it keeps pairs together, ie: matched earrings, cuff links etc.

b) it keeps backs of pierced earings on.

c) it eliminates scratching of precious items.

d) it allows easy view of accessories at a glance.

e) it can be used when traveling.

g) it hangs, it's pretty and it is light weight.

As many changes are possible to the embodiment of this invention utilizing the teachings thereof, the descriptions above, and the accompanying drawings should be interpreted in the illustrative and not the limited sense.

I claim:

1. An orgainzer for fashion accessories which is hung on a vertical support wall, comprising:

a. a thin, flexible base constructed of burlap and having a predetermined rectilinear configuration and a periphery, said base further having a plurality of button hole apertures therein, each of which has a reinforced periphery;

b. a trim member constructed of a lace material disposed about and attached to said base periphery;

c. a hanger attached to said base at said periphery thereof, said hanger being for attachment to hanger means attached to the vertical support wall, said hanger being constructed of a lace material, said lace material having a pair of ends each of which is attached to said base at separate points such that a loop is formed for engagement with the hanger means;

d. a pair of wooden rods attached to said base via glue at two predetermined points on the same side of said base, said rods having a diameter of approximately one half centimeter such that said base is spaced apart from the support wall; and e. at least one protection pad attached to each said rod to prevent said rod from scratching the support wall, whereby the organizer is hung in a substantially flat, uncurled configuration on the support wall, and whereby fashion accessories are insertable through said burlap base and said button hole apertures thereon and are securely held in a visible and easily accessible orientation thereon.

* * * * *